US006290316B1

(12) United States Patent
Buckby

(10) Patent No.: US 6,290,316 B1
(45) Date of Patent: Sep. 18, 2001

(54) METHOD OF PRINTING

(75) Inventor: Steven John Buckby, East Bridford (GB)

(73) Assignee: Markem Technologies Limited, Nottingham (GB)

( * ) Notice: Subject to any disclaimer, the term of this patent is extended or adjusted under 35 U.S.C. 154(b) by 0 days.

(21) Appl. No.: 09/082,947

(22) Filed: May 21, 1998

(30) Foreign Application Priority Data

May 21, 1997 (GB) ..... 9710373

(51) Int. Cl.[7] ..... B41J 29/38
(52) U.S. Cl. ..... 347/14
(58) Field of Search ..... 347/14, 19, 7, 347/49, 23, 15, 12, 10, 183, 11, 17, 8; 395/112; 400/74

(56) References Cited

U.S. PATENT DOCUMENTS

| | | | | |
|---|---|---|---|---|
| 5,285,220 | * | 2/1994 | Suzuki et al. | 347/19 |
| 5,343,231 | | 8/1994 | Suzuki . | |
| 5,483,265 | * | 1/1996 | Kneezel et al. | 347/14 |
| 5,610,637 | * | 3/1997 | Sekiya et al. | 347/10 |

FOREIGN PATENT DOCUMENTS

| | | |
|---|---|---|
| 0 605 216 B1 | 7/1994 | (EP) . |
| 0 665 105 A1 | 8/1995 | (EP) . |
| 0 709 192 A2 | 5/1996 | (EP) . |

OTHER PUBLICATIONS

Patent Abstracts of Japan, JP 01 299049 A (Fuji Xerox Co Ltd), Dec. 1989.
European Search Report.

* cited by examiner

*Primary Examiner*—John Barlow
*Assistant Examiner*—Charles W. Stewart, Jr.
(74) *Attorney, Agent, or Firm*—Fish Richardson P.C.

(57) ABSTRACT

A method of printing utilises a print head comprising a plurality of printing elements which may be actuated independently to print on a substrate, and a control means which produces control signals for the printing elements for independently addressing and controlling the printing elements so that the print head may print a desired character, the method comprising analysing the performance of the individual printing elements to determine the printing characteristic of the print head and to produce control data, feeding the control data to the control means which utilises the control data to compensate for variations in the performance of the individual printing elements whereby the control means produces modified control signals for the printing elements so as to adjust the printing characteristic of the print head, wherein the control means compensates for variations in the performance of the printing elements by activating one or more of the printing elements at a different time to others of the printing elements when printing a row of image.

23 Claims, 1 Drawing Sheet

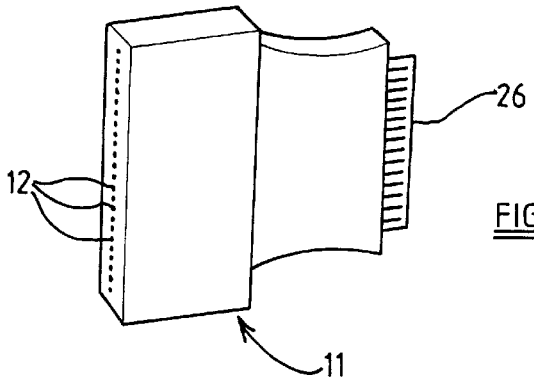
FIG 1
FIG 2
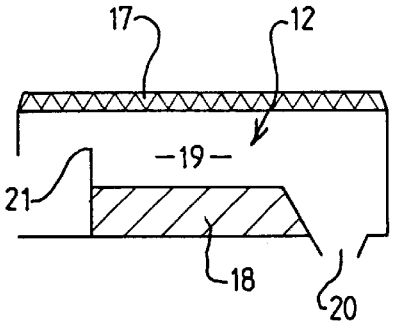
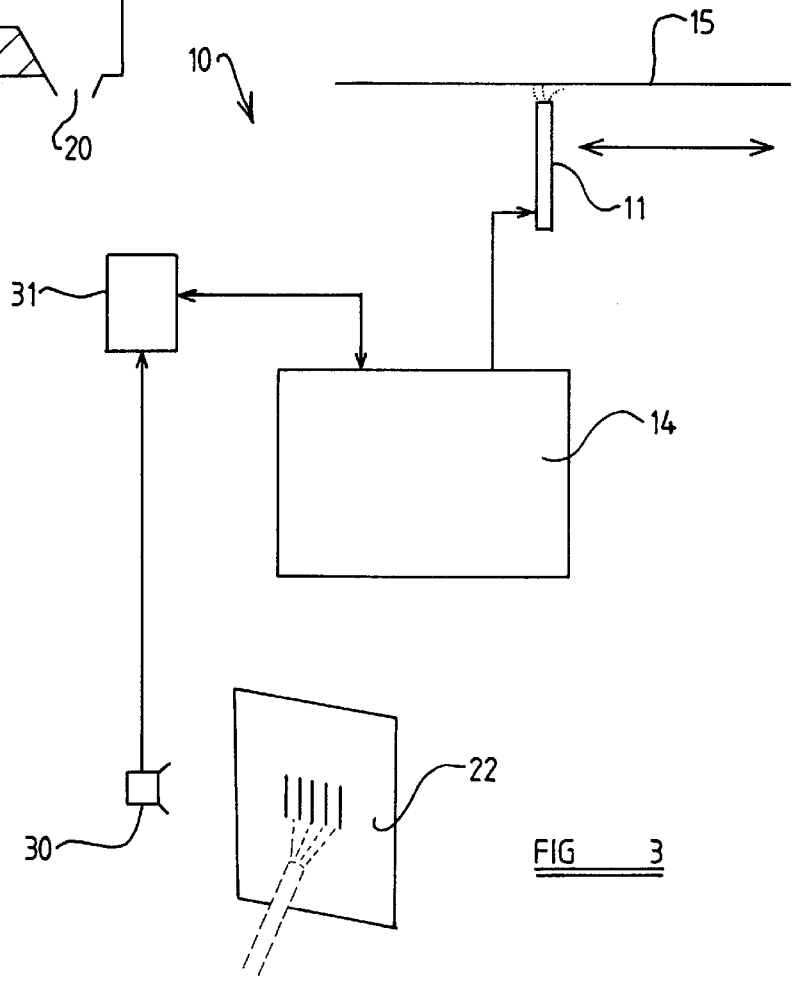
FIG 3

METHOD OF PRINTING

BACKGROUND TO THE INVENTION

This invention relates to a method of printing and more particularly to a method of printing utilising a print head of the so called ink jet kind, although the invention may be applied to a method of printing having other kinds of print head comprising a plurality of printing elements which may be actuated independently to print on a substrate.

In one kind of ink jet printer, there is provided an array of printing elements e.g. arranged in a linear or substantially linear array, and each of which may create a jet of ink and propel the ink towards a substrate. The jets may be created by, for example, passages in the print head which are caused to constrict by piezzo electric means, to squeeze ink therefrom or by other similar means.

The design and manufacturing tolerances of such print heads is demanding and it will be appreciated by those skilled in the art, that the performance of the individual printing elements will in practice vary, such that print heads tend to be imperfect. This variation in performance of the printing elements leads to print image irregularities. Where the variation in performance of the individual printing elements is too great, the print head has to be rejected.

The variation in performance may mean that the amount of ink and/or the velocity of the ink in the created jet is not constant for all of the printing elements. The latter of these produces the result that the ink in one or more jets reaches the substrate at a different time to ink from others of the jets, even where the jets travel substantially the same distance from the print head to the substrate. In general, in a printer of this kind, during printing there is relative movement between the substrate and the print head, and consequently, the quality of the image is impaired by an amount proportional to the velocity variation.

SUMMARY OF THE INVENTION

According to a first aspect of the invention we provide a method of printing utilising a print head comprising a plurality of printing elements which may be actuated independently to print on a substrate, and a control means which produces control signals for the printing elements for independently addressing and controlling the printing elements so that the print head may print a desired character, wherein the method comprises analysing the performance of the individual printing elements to determine the printing characteristic of the print head and to produce control data, feeding the control data to the control means which utilises the control data to compensate for variations in the performance of the individual printing elements whereby the control means produces modified control signals for the printing elements so as to adjust the printing characteristic of the print head, and wherein the control means uses the control data to compensate for variation in performance of the printing elements by actuating one or more of the printing elements at a different time to others of the printing elements.

Thus, in an ink jet type printer as described above, when printing a row of image the ink from all of the jets reaches the substrate at the same time. Additionally, the control means may use the control data to compensate for variation in performance of the printing elements by providing a control signal to one or more of the printing elements at a power different to others of the printing elements.

In each case, the variation in performance of the printing elements is compensated for so that the quality of the resultant image is improved.

The characteristic of the print head may be determined at least in part by causing the print head to print a test print, and electronically examining the test print to produce a control data input to the control means but other analysing steps may be canied out for a particular kind of print head.

Where the printing elements each comprise means to create a jet of ink and to propel the ink to the substrate, the characteristic of the print head may be determined, at least in part by deriving for each printing element, a measure of the velocity of ink drops in the ink jet created thereby to produce the control data, using for example an electronic imaging means which provides a control data input to the control means.

According to a second aspect of the invention we provide a printing apparatus comprising a print head comprising a plurality of printing elements which may be actuated independently to print on a substrate, and a control means which produces control signals for the printing elements for independently addressing and controlling the printing elements so that the print head may print a desired character, characterised in that means are provided for analysing the performance of the individual printing elements to determine the printing characteristic of the print head and to produce control data, means to feed the control data to the control means which utilises the control data to compensate for variations in the performance of the individual printing elements whereby the control means produces modified control signals for the printing elements so as to adjust the printing characteristic of the print head.

The apparatus may have a print head of the kind in which the printing elements each comprise means to create a jet of ink and to propel the ink to the substrate and the means which analyses the performance of the individual printing elements, measures for each printing element, the velocity of ink drops in the ink jet created thereby to produce the control data, using an electronic imaging means which provides a control data input to the control means.

BRIEF DESCRIPTION OF THE DRAWINGS

The invention will now be described with the aid of the accompanying drawings in which:

FIG. 1 is an illustrative perspective view of a print head for use in the method of the invention;

FIG. 2 is an illustrative enlarged cross sectional view through the print head of FIG. 1;

FIG. 3 is an illustrative diagram of a printing apparatus embodying the invention.

DESCRIPTION OF THE PREFERRED EMBODIMENT

Referring to the drawings, a printing apparatus 10 comprises a print head 11 of the so called ink jet kind, having a plurality of printing elements 12 arranged in a linear or substantially linear array, and each adapted, under the control of a control means 14, independently from each other to propel the ink towards a substrate 15. An image is printed by selecting printing elements (12) at each of plurality of image row positions, so that the image comprises a plurality of of rows of print.

For example, the print head 11 may be of the PZT type having a plurality of strips 17 of material which exhibit piezzo electric properties and move resiliently when an electrical signal is provided thereto, and a layer 18 of more rigid material attached thereto, there being a passage 19 between each piezzo electric strip 17 and the more rigid layer 18.

Ink is fed to each of the passages 19 under slight pressure, and when an electrical signal is provided to a piezzo electric strip 17, the strip 17 deforms to cause a jet of ink to be generated at a jet outlet orifice 20 from the associated passage 9 and to be propelled therefrom.

There are several different print head designs relating to this technology and further detailed description of the design of the print head 11 is not considered necessary. However, as seen in FIG. 2, each passage 19 may include a constriction 21 to help develop the jet of ink, and typically, an electrical signal of about 200V is applied to the strip 17 of piezzo electric material. In practice, the print head 11 may comprise a substantial number of printing elements 12, e.g. 256 such elements 12, each element 12 being individually addressable and controllable by a computer controlled control means 14, and to this end the print head 11 may have a multi-circuit connector 26 to enable an electrical connection to be made with the piezzo electric strips 17 of each of the individual printing elements 12. Each printing element 12 will, when selected and actuated, thus produce a jet of ink at the outlet orifice 20 thereof.

In use, the print head 11 may be moved relative to a stationary substrate 15 such as a piece of paper, or an item of packaging, or the substrate 15 may be moved relative to a stationary print head 11, again under the control of the control means 14, continuously or in stepped fashion, with the array of printing elements 12 being arranged transversely to the substrate 15, and being moved relative to the substrate 15, whilst individual printing elements 12 are selected and actuated in each of a plurality of image row positions so as to print one or more desired characters on the substrate 15.

Each jet of ink created by each printing element 12 will comprise a plurality of individual drops of ink. Conventionally, a selected number of the printing elements 12 are actuated simultaneously by the control means 14 at each pixel row position along the image to produce a plurality of pixels of ink across the substrate 15 at each pixel position along the substrate 15. Even though the distance the droplets of ink need to travel from the print head 11 to the substrate 15 may be the same for all of the actuated printing elements 12, because of manufacturing tolerances in the sizes of the passages 19 and of the outlet orifices 20 thereof the performance of the printing elements 12, i.e. the amount of ink in any jet created, and the velocity of the ink in the jet, may vary compared to others of the printing elements 12.

To compensate for this, the control means 14 in the arrangement of the invention, utilises control data fed thereto, to produce modified control signals for the printing elements 12 so as to adjust the printing characteristic of the print head 11. For example, the control data may indicate that the velocity of the ink in a jet from one or more of the printing elements 12 is slower than for one or more of the remaining printing elements 12 and thus may compensate for this by providing the electrical signal or signals to the or each respective, slower, printing element 12, earlier than to the or the remainder of the printing elements 12, at each pixel row position along the substrate 15, so that the ink from all of the actuated printing elements impinges upon the substrate 15 at the same time. In this way the quality of the image which is printed on the substrate 15 is improved.

The control data may be derived from an analysis of the performance of the print head 11 for example by inspecting a test print 22 and/or by deriving a measure of ink droplet speed for each jet created by the printing elements 12. Preferably such analysis is performed using an electronic imaging means, such as a camera 30 which produces digital data which may be fed to the control means 14 as an input.

The control data may be stored, for example in a look up table 31, and may be used by the control means 14 when determining when to actuate the printing elements 12 of the print head 11, during the printing operation.

Various modifications may be made without departing from the scope of the invention.

For example as indicated above, the invention may be applied to in jet type printing apparatus in which jets of ink are produced by the printing elements 12 otherwise than as described, or the invention may be applied to another kind of printer altogether such as a thermal transfer type of printer where the performance of individual printing elements may vary.

The invention encompasses not only actuating one or more printing elements at different times to others of the printing elements, but also varying the power of the electrical signal applied to one or more of the printing elements, e.g. to ensure more uniformity of printing by each of the printing elements.

In the example described, the control means 14 is illustrated as being separate from but electrically connected to the print head 12, but in another arrangement, the print head 11 may have part of the control means provided integrally therewith. For example, the look up table or other store for the control data, when derived from an analysis of the printing characteristic of the print head 11, may be provided in or on the print head 11.

What is claimed is:

1. A method of printing utilizing a piezo electric print head comprising a plurality of independently actuatable printing elements operable to print on a substrate, and a controller which produces control signals for the printing elements for independently addressing and controlling the printing elements so that the print head may print a desired character, wherein the method comprises analyzing the performance of the individual printing elements to determine the printing characteristic of the print head and to produce control data, feeding the control data to the controller which utilizes the control data to compensate for variations in jet velocity of the individual printing elements whereby the controller produces modified control signals for the printing elements so as to adjust the printing characteristic of the print head, and wherein the controller compensates for variation in jet velocity of the printing elements by actuating one or more of the printing elements at a different time to others of the printing elements.

2. A method according to claim 1 wherein additionally the controller provides a control signal to one or more of the printing elements to control the power to the printing elements to compensate for variations in performance of the printing elements.

3. A method of printing according to claim 1 comprising causing the print head to print a test print, and electronically examining the test print to produce a control data input to the controller.

4. A method of printing according to claim 1 wherein the printing elements are arranged in a linear or substantially linear array.

5. A method of printing according to claim 1 wherein the printing elements each create a jet of ink and propel the ink to the substrate.

6. A method of printing according to claim 5 wherein the charcteristic of the print head is determined at least in part by deriving for each printing element, a measure of the velocity of ink drops in the ink jet created therby to produce the control data.

7. A method of printing according to claim 6 wherein the measures of the velocities of the ink drops in the ink jets created by the printing elements are derived utilizing an electronic imager which provides a control data input to the controller.

8. A method of printing according to any one of the preceding claims wherein the method includes relative motion between the substrate relative to the print head during printing.

9. A piezoelectric printing apparatus comprising a print head comprising a plurality of independently actuatable printing elements operable to print on a substrate, and a controller which produces control signals for the printing elements for independently addressing and controlling the printing elements so that the print head may print a desired character, wherein the controller utilizes control data to compensate for variations in jet velocity of the individual printing elements whereby the controller produces modified control signals for the printing elements so as to adjust the printing characteristic of the print head, and wherein the controller is adapted to compensate for variation in jet velocity of the printing elements by actuating one or more of the printing elements at a different time to others of the printing elements.

10. A printing apparatus according to claim 9 wherein the printing elements each create a jet of ink and propel the ink to the substrate and for each printing element, a measure of the velocity of ink drops in the ink jet created thereby to produce the control data.

11. A printing apparatus according to claim 10 wherein the means which measures the velocities of the ink drops in the ink jets created by the printing elements comprises an electronic imager which provides a control data input to the controller.

12. An ink jet printer system including a print head comprising a plurality of actuatable jet elements addressable by a controller, wherein the controller utilizes data representative of the relative velocity of said jet elements to control the relative time of actuation of said elements, thereby compensating for jet velocity differences among the elements so that image quality is improved by reducing differences in time that ink from actuated elements reaches substrate.

13. The ink jet printer system of claim 12 wherein the data is stored in a look-up table.

14. The ink jet printer system of claim 13 wherein the look-up table is provided in or on the print head.

15. The ink jet printer system of any one of claims 12, 13, or 14 wherein the data is generated by inspection of a test print.

16. The ink jet printer system of claim 15 wherein the data is generated by digital imaging of the test print.

17. The ink jet printer system of claim 16 wherein the ink jet printer system includes a piezoelectric ink jet print head.

18. The ink jet printer system of claim 15 wherein the ink jet printer system includes a piezoelectric ink jet print head.

19. The ink jet printer system of any one of claims 12, 13, or 14 wherein the controller varies the power to one or more of the printing elements.

20. The ink jet printer system of claim 19 wherein the ink jet printer system includes a piezoelectric ink jet print head.

21. The ink jet printer system of any one of claims 12, 13, or 14 wherein there is relative movement between the print head and a substrate during printing.

22. The ink jet printer system of claim 21 wherein the ink jet printer system includes a piezoelectric print head.

23. The ink jet printer system of any one of claims 12, 13, or 14 wherein the ink jet printer system includes a piezoelectric ink jet print head.

* * * * *